US011096462B2

(12) United States Patent
Ritchie

(10) Patent No.: US 11,096,462 B2
(45) Date of Patent: Aug. 24, 2021

(54) CLASP SYSTEM FOR BAGGAGE ITEMS

(71) Applicant: MRM HK Limited, Hong Kong (HK)

(72) Inventor: Luke Ritchie, Hong Kong (HK)

(73) Assignee: MRM HK Limited, Hong Kong (HK)

( * ) Notice: Subject to any disclaimer, the term of this patent is extended or adjusted under 35 U.S.C. 154(b) by 891 days.

(21) Appl. No.: 15/874,181

(22) Filed: Jan. 18, 2018

(65) Prior Publication Data

US 2019/0159565 A1 May 30, 2019

Related U.S. Application Data

(60) Provisional application No. 62/592,872, filed on Nov. 30, 2017.

(51) Int. Cl.

| | |
|---|---|
| ***A45C 13/10*** | (2006.01) |
| ***A45C 13/26*** | (2006.01) |
| ***A45C 3/00*** | (2006.01) |
| ***A44B 99/00*** | (2010.01) |

(52) U.S. Cl.

CPC ..... *A45C 13/10* (2013.01); *A44B 99/005* (2013.01); *A45C 3/00* (2013.01); *A45C 13/1092* (2013.01); *A45C 13/26* (2013.01)

(58) Field of Classification Search

CPC ..... A45C 13/10; A45C 13/1092; A45C 13/26; A45C 3/00; A44B 99/005

See application file for complete search history.

(56) References Cited

U.S. PATENT DOCUMENTS

| | | | | |
|---|---|---|---|---|
| 4,031,724 | A * | 6/1977 | Atkinson | A44B 19/301 70/68 |
| 4,066,195 | A | 1/1978 | Dickler | |
| 4,213,314 | A | 7/1980 | Trader | |
| 4,240,480 | A | 12/1980 | Strobel | |
| 4,262,718 | A * | 4/1981 | Stark | E05B 65/5269 150/118 |
| 4,792,026 | A | 12/1988 | Dimmick et al. | |
| 4,888,858 | A * | 12/1989 | Kasai | A44B 11/266 24/163 R |

(Continued)

FOREIGN PATENT DOCUMENTS

| | | | |
|---|---|---|---|
| GB | 2451659 | A | 2/2009 |
| GB | 2506437 | A | 4/2014 |
| WO | WO0231786 | A1 | 4/2002 |

*Primary Examiner* — Robert Sandy
*Assistant Examiner* — David M Upchurch
(74) *Attorney, Agent, or Firm* — Faegre Drinker Biddle & Reath LLP

(57) ABSTRACT

A clasp system includes a first clasp element that is carried by a first article of a baggage item. The first clasp element includes a rim and an elongated aperture is defined within the rim. The clasp system further includes a second clasp element that is carried by a second article of the baggage item. The second clasp element includes a base, a shaft, and a handle. The handle is movable through the aperture. The first clasp element and the second clasp element are reconfigurable from an unclasped configuration to a clasped configuration and vice versa. In the unclasped configuration the first clasp element and the second clasp element are disposed apart from each other. In the clasped configuration the base is disposed on a first side of the rim, the shaft extends through the aperture, and the handle is disposed on a second side of the rim.

5 Claims, 14 Drawing Sheets

(56) References Cited

U.S. PATENT DOCUMENTS

| | | | | |
|---|---|---|---|---|
| 4,995,436 | A | 2/1991 | Cantor | |
| D340,122 | S * | 10/1993 | Wakabayashi | D11/218 |
| 5,689,979 | A | 11/1997 | Yu | |
| 5,915,631 | A | 6/1999 | Laxton et al. | |
| 6,851,285 | B1 | 2/2005 | Haas | |
| 7,086,255 | B2 | 8/2006 | Reason | |
| 7,367,482 | B1 | 5/2008 | Witherspoon, Jr. | |
| 7,814,949 | B2 | 10/2010 | Surface et al. | |
| 2007/0240798 | A1 | 10/2007 | Bihler | |
| 2010/0122560 | A1 | 5/2010 | Ricker et al. | |
| 2010/0027921 | A1 | 9/2010 | Franklin et al. | |
| 2012/0125494 | A1 | 5/2012 | Avganim | |
| 2013/0133795 | A1 * | 5/2013 | Zhou | A45C 13/22 150/104 |
| 2013/0299540 | A1 | 11/2013 | Avganim | |
| 2017/0086554 | A1 | 3/2017 | Felix | |
| 2017/0127767 | A1 * | 5/2017 | Paik | A45C 13/1069 |

* cited by examiner

CLASP SYSTEM FOR BAGGAGE ITEMS

CROSS-REFERENCE TO RELATED APPLICATION

The present application claims the benefit of and priority to U.S. Provisional Application Ser. No. 62/592,872, filed Nov. 30, 2017, entitled CLASP SYSTEM FOR BAGGAGE ITEMS, which is hereby incorporated by reference in its entirety for all that it teaches and for all purposes.

TECHNICAL FIELD

The present invention relates to a clasp system for connecting flexible articles, such as straps and other surfaces, of baggage items, such as purses and backpacks.

BACKGROUND

Systems for securing baggage items (for example, purses, handbags, shoulder bags, and backpacks) to other structures (for example, the legs or arms of chairs) have been developed to deter and prevent theft of such baggage items. However, such systems can be relatively complicated and difficult to use. There remains, therefore, a continuing need for improved securement systems for baggage items.

SUMMARY

A clasp system according to a first exemplary embodiment of the present invention includes a first clasp element that is configured to be carried by a first article of a baggage item. The first clasp element includes a rim that is configured to be coupled to the first article of the baggage item. The rim has a first side and a second side. An elongated aperture is defined within the rim and extends from the first side to the second side of the rim. A first clasp feature is coupled to and extends away from the rim. The clasp system further includes a second clasp element that is configured to be carried by a second article of the baggage item. The second clasp element includes a base that is configured to be coupled to the second article of the baggage item. A shaft is coupled to the base, and the shaft has a shaft axis. A handle is coupled to the shaft opposite the base. The handle is movable through the aperture. The handle is pivotable relative to the shaft about a pivot axis. The handle includes a second clasp feature. The first clasp element and the second clasp element are reconfigurable from an unclasped configuration to a clasped configuration and vice versa. In the unclasped configuration the first clasp element and the second clasp element are disposed apart from each other. In the clasped configuration the base is disposed on the first side of the rim, the shaft extends through the aperture, the handle is disposed on the second side of the rim, and the second clasp feature engages the first clasp feature to secure the first clasp element and the second clasp element.

While multiple embodiments are disclosed, still other embodiments of the present invention will become apparent to those skilled in the art from the following description, which shows and describes illustrative embodiments of the invention. Accordingly, the drawings and description are to be regarded as illustrative in nature and not restrictive.

BRIEF DESCRIPTION OF THE DRAWINGS

Embodiments of the present invention will now be described by way of example with reference to the accompanying drawings, wherein:

In FIG. 3, the first clasp element is shown in an inverted orientation (that is, upside-down) compared to the other figures.

In FIGS. 11-13, the clasp system is shown in an inverted orientation (that is, upside-down) compared to the other figures.

FIG. 13 is a side view of the clasp system of FIG. 1 in the clasped configuration.

It should be understood that the drawings are intended to facilitate understanding of exemplary embodiments of the present disclosure are not necessarily to scale.

DETAILED DESCRIPTION OF THE DRAWINGS

Figure 1:
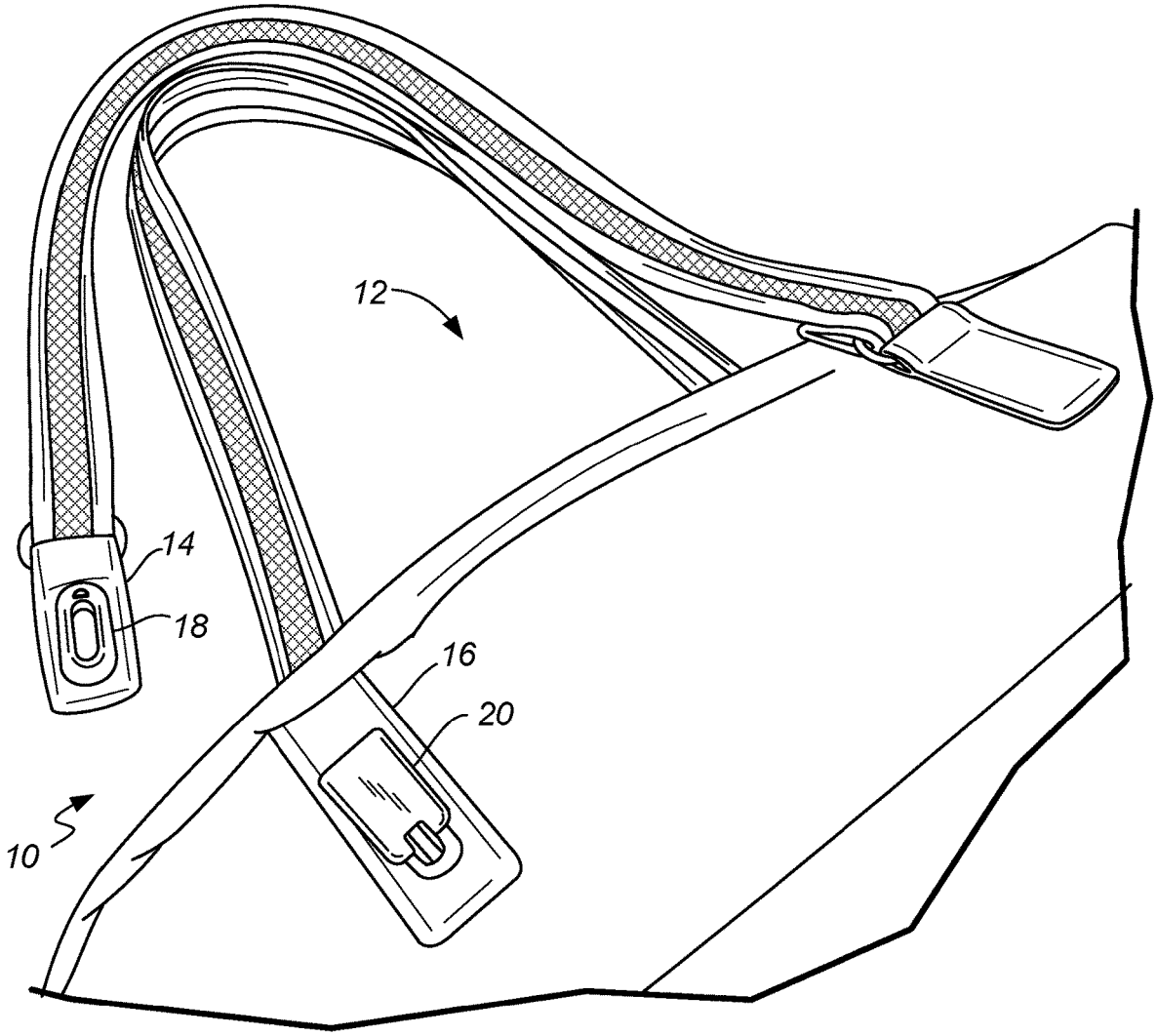
FIG. 1 is a perspective view of a clasp system coupled to an exemplary baggage item; the clasp system is illustrated in an unclasped configuration.
Figure 2A:
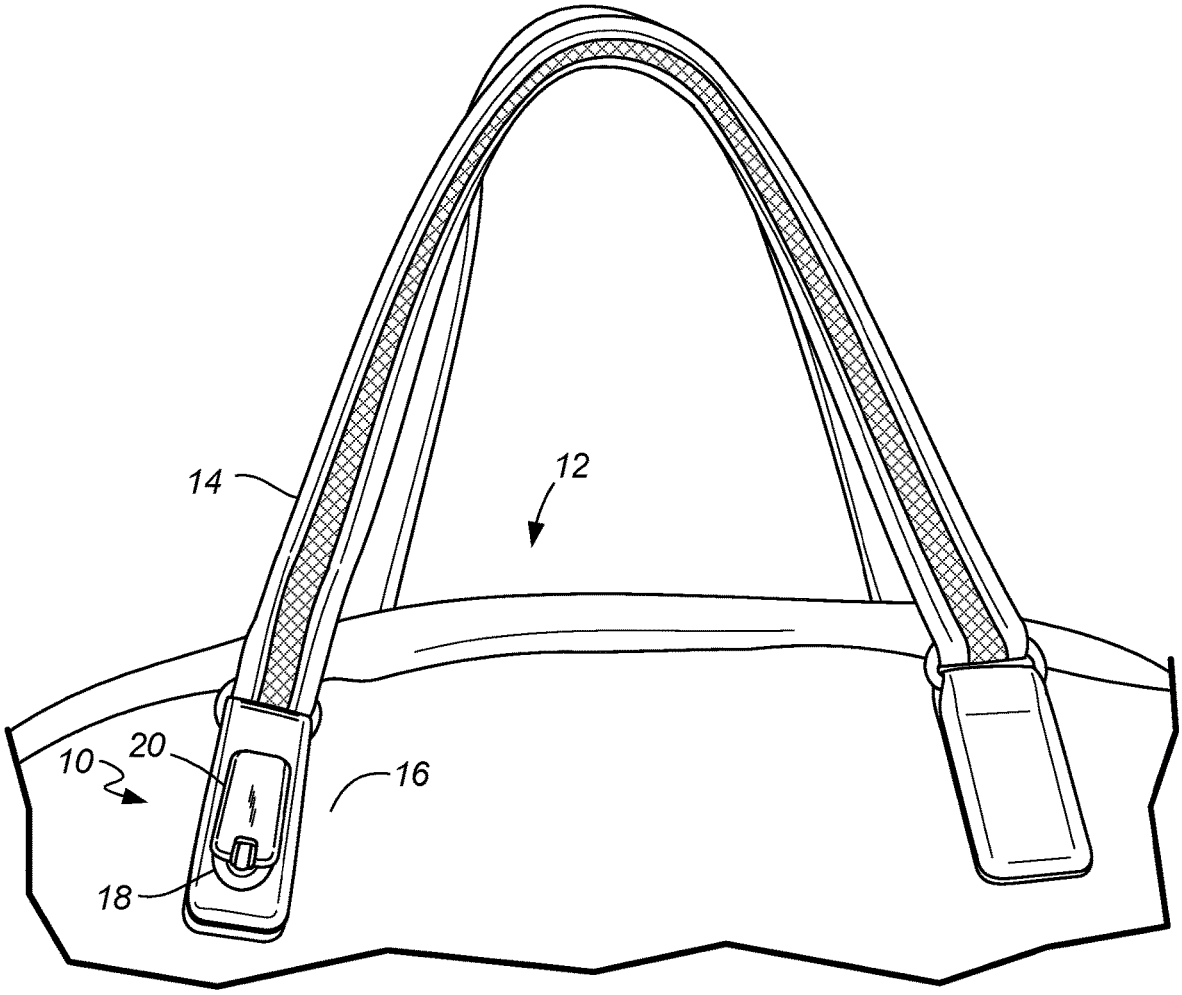
FIGS. 2A and 2B are perspective views of the clasp system and baggage item of FIG. 1; the clasp system is illustrated in a clasped configuration.
Figure 2B:
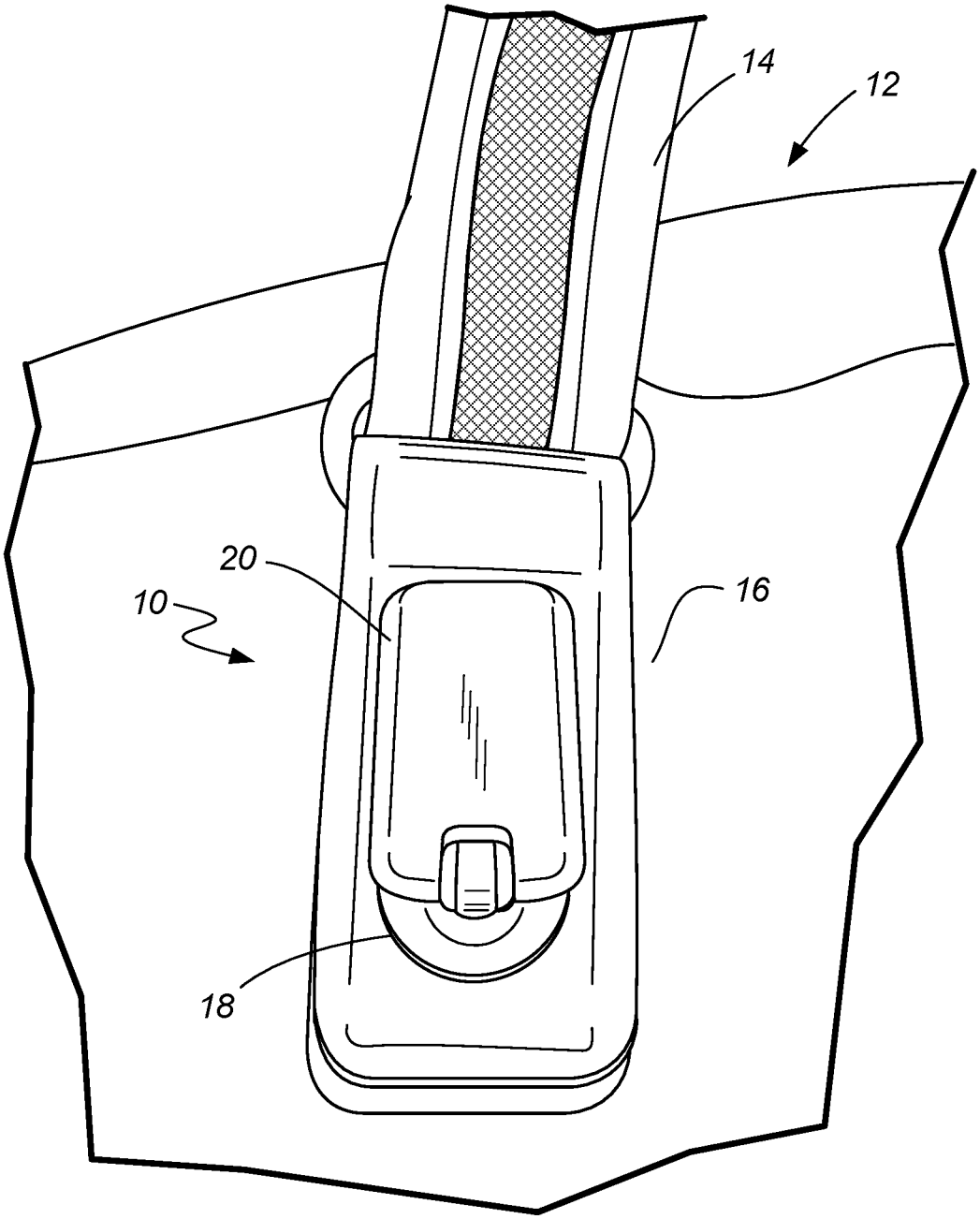

FIGS. 1, 2A, and 2B illustrate a clasp system 10 according to an embodiment of the present invention coupled to an exemplary baggage item 12 (for example, a bag, purse, handbag, shoulder bag, backpack, or the like). The clasp system 10 is carried by two articles 14, 16 of the baggage item 12 (for example, a flexible strap and another surface of the baggage item 12, two straps, or the like). The clasp system 10 is selectively reconfigurable from an unclasped configuration (see FIG. 1—also referred to as an open configuration or an unlocked configuration) to a clasped configuration (see FIGS. 2A and 2B—also referred to as a closed configuration and a locked configuration) and vice versa. In the unclasped configuration, the clasp system 10 does not secure the two articles 14, 16 of the baggage item 12 to each other. In the clasped configuration, the clasp system 10 secures the two articles 14, 16 of the baggage item 12 to each other. Accordingly, in the unclasped configuration, one of the articles 14, 16 may be wrapped about another structure (for example, the leg or arm of chair—not shown). The clasp system 10 may then be reconfigured to the closed configuration to secure the two articles 14, 16 of the baggage item 12 to each other and thereby secure the baggage item 12 to the structure.

Generally, the clasp system 10 includes first clasp element 18 carried by a first of the articles 14 of the baggage item 12 and a second clasp element 20 carried by a second of the articles 16 of the baggage item 12. The first clasp element 18 and the second clasp element 20 are disposed apart from each other in the unclasped configuration, and the first clasp element 18 and the second clasp element 20 are secured to each other in the clasped configuration.

Figure 3:
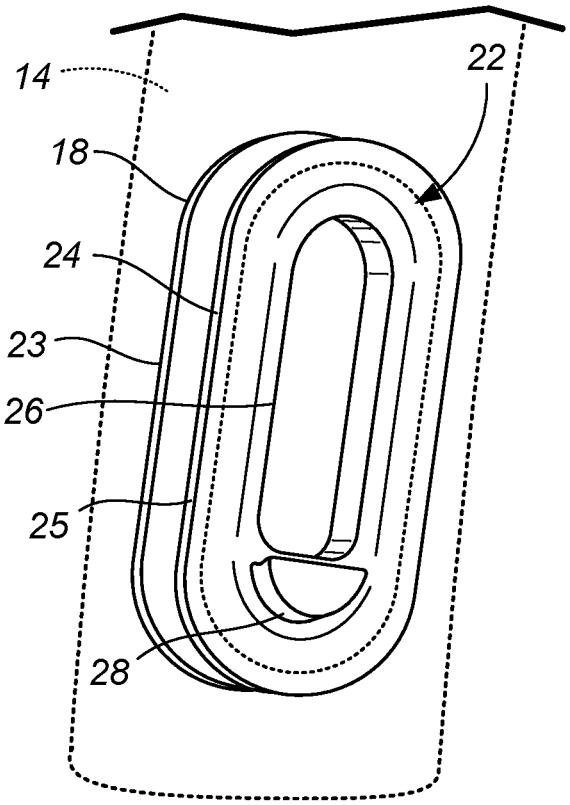
FIG. 3 is a detail perspective view of a first clasp element of the clasp system of FIG. 1.
Figure 4:
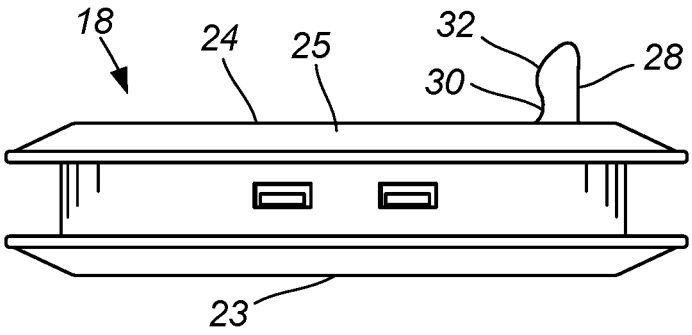
FIG. 4 is a side view of the first clasp element of the clasp system of FIG. 1.
Figure 5:
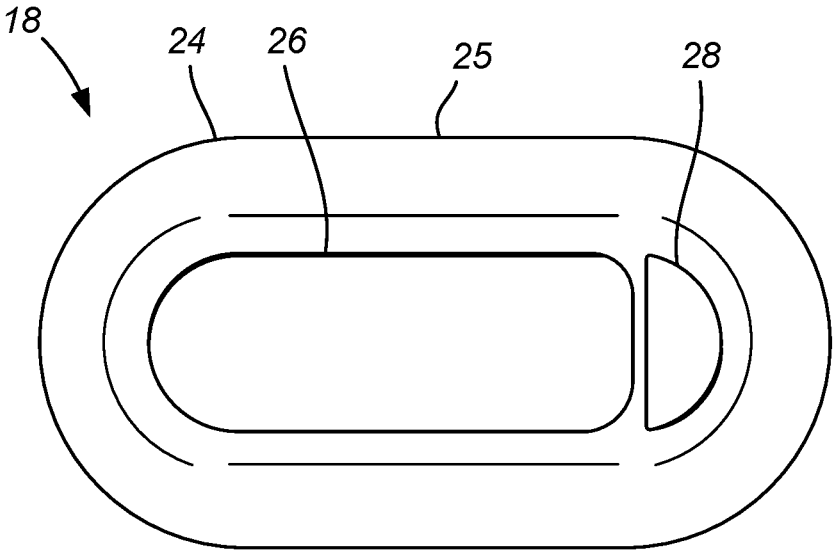
FIG. 5 is a front view of the first clasp element of the clasp system of FIG. 1.

FIGS. 3-5 illustrate the first clasp element 18 of the clasp system 10, which is carried in and extends outwardly from an opening 22 of the first article 14 of the baggage item 12. The first clasp element 18 includes a rim 24 that illustratively includes an oval shape, although other shapes are also contemplated. The rim 24 includes a back portion 23 and a front portion 25 that are detachably couplable and facilitate positioning the rim 24 in the opening 22 of the first article 14. The rim 24 defines an aperture 26 therein, and the aperture 26 is elongated along a longitudinal axis. The rim 24 and the aperture 26 are generally disposed in a common plane (illustratively, a plane defined by the first article 14 of the baggage item 12), and the first clasp element 18 further includes a first clasp feature 28 that extends away from the plane. The first clasp feature 28 facilitates securing the first clasp element 18 to the second clasp element 20 in the clasped configuration. Referring specifically to FIG. 4, the first clasp feature 28 has a general "prong" or "hook" shape that includes a first or relatively narrow portion 30 near the rim 24 and second or relatively a wide portion 32 further from the rim 24. The first portion 30 is narrower than the second portion 32 in a direction substantially parallel to the longitudinal axis of the aperture 26.

Figure 6:
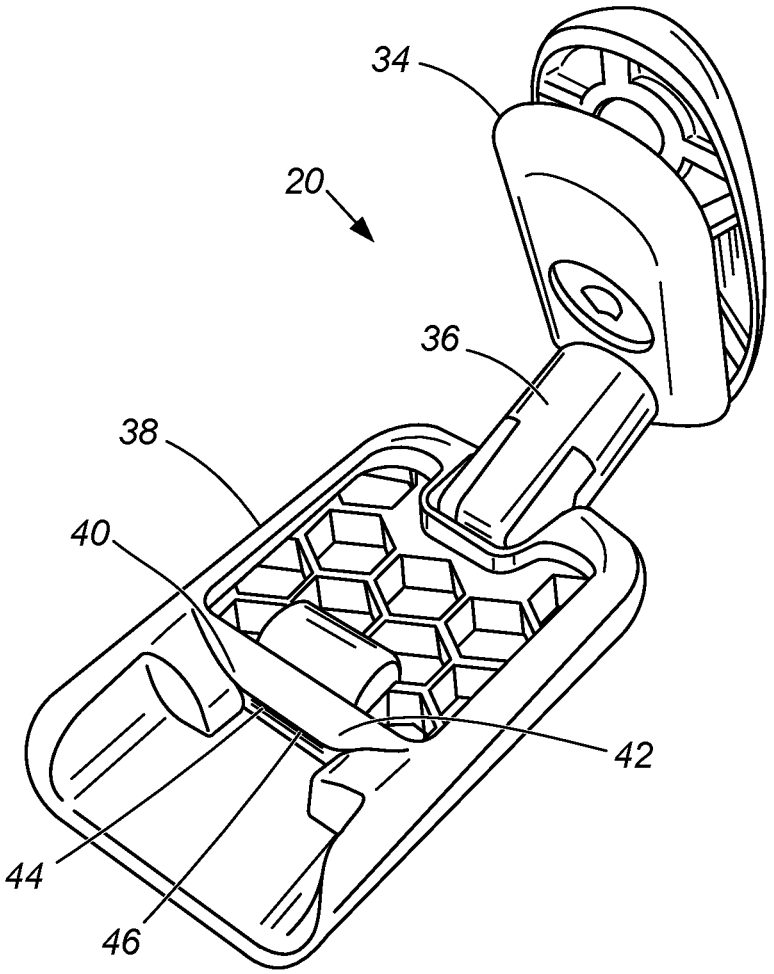
FIG. 6 is a perspective view of the second clasp element of the clasp system of FIG. 1.
Figure 7:
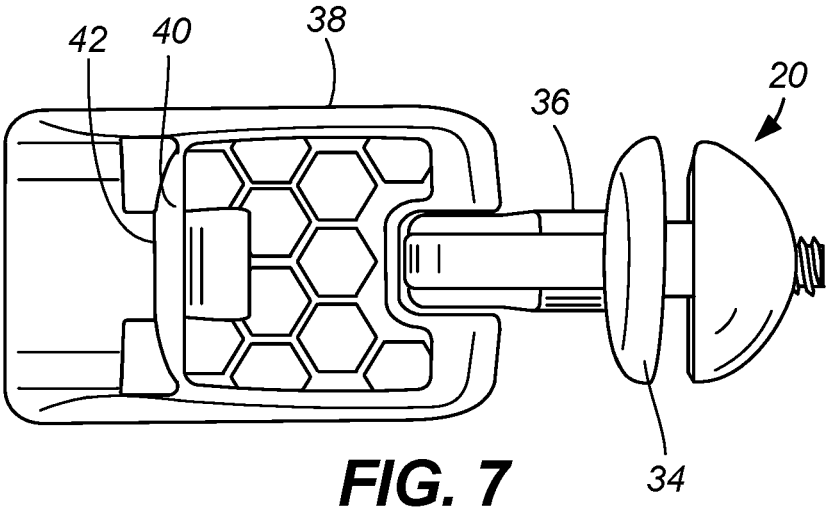
FIG. 7 is a bottom view of the second clasp element of the clasp system of FIG. 1.
Figure 8:
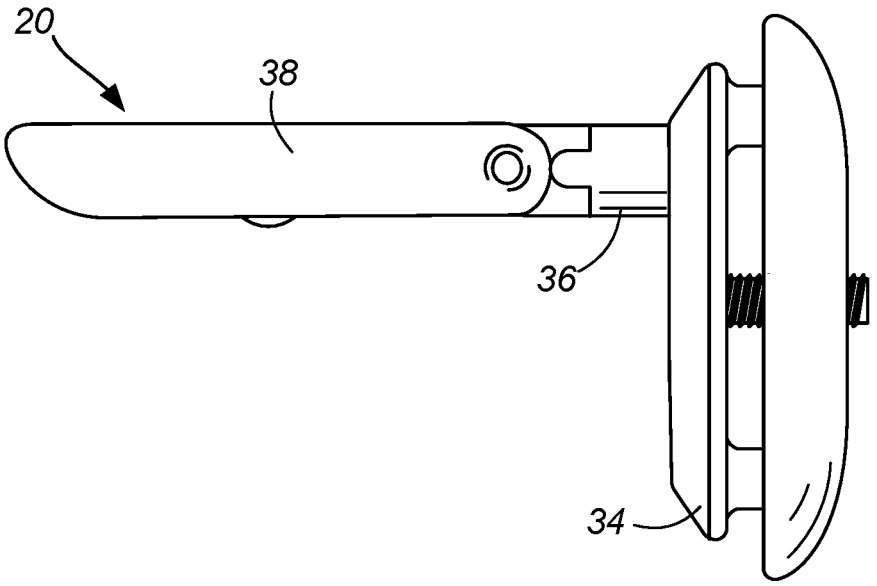
FIG. 8 is a side view of the second clasp element of the clasp system of FIG. 1.

FIGS. 6-8 illustrate the second clasp element 20 of the clasp system 10, which is carried by the second article 16 of the baggage item 12 (shown elsewhere). The second clasp element 20 includes a base 34 that couples to the second article 16 of the baggage item 12. The base 34 is generally disposed in a plane (illustratively, a plane defined by the second article 16 of the baggage item 12), and the second clasp element 20 further includes a shaft 36 that extends from the base 34. Illustratively, an axis of the shaft 36 is substantially perpendicular to the plane of the base 34. Opposite the base 34, the shaft 36 pivotably couples to a handle 38. Illustratively, the handle 38 pivots relative to the shaft 36 about a pivot axis that is substantially perpendicular to the shaft axis and substantially parallel to the plane of the base 34. The handle 38 is generally disposed in a plane, which is also pivotable relative to the shaft 36. The handle 38 includes a second clasp feature 40 that is secured to the first clasp feature 28 of the first clasp element 18 (shown elsewhere) in the clasped configuration. Referring specifically to FIG. 6, the second clasp feature 40 includes a ridge 42 and an adjacent recessed surface 44 that define a pocket 46 for receiving the relatively wide portion 32 of the first clasp feature 28 (shown elsewhere).

The first clasp feature 18 and the second clasp feature 40 may take various other forms. For example, the first clasp feature 18 may be a cylindrical protrusion and the second clasp feature 40 may be a cylindrical recess, and the cylindrical recess may receive and frictionally engage the cylindrical protrusion to secure the clasp system 10 in the clasped configuration.

The second clasp feature 40 and the first clasp feature 28 may be positioned, provided with dimensions, and/or formed with relatively stiff materials (including, for example, metals, plastics, and ceramics) that necessitate application of relatively large forces to disengage the features and thereby unclasp the clasp system 10. More specifically, the relatively wide portion 32 of the first clasp feature 28 and the ridge 42 of the second clasp feature 40 may be positioned and/or provided with dimensions that facilitate a relatively large amount of interference between the features 28, 40, thereby necessitating application of relatively large forces to slide the second clasp feature 40 relative to the first clasp feature 28 and disengage the features 28, 40.

FIGS. 9-12 are views of the clasp system 10 of being reconfigured from the unclasped configuration to the clasped configuration.

Figure 9:
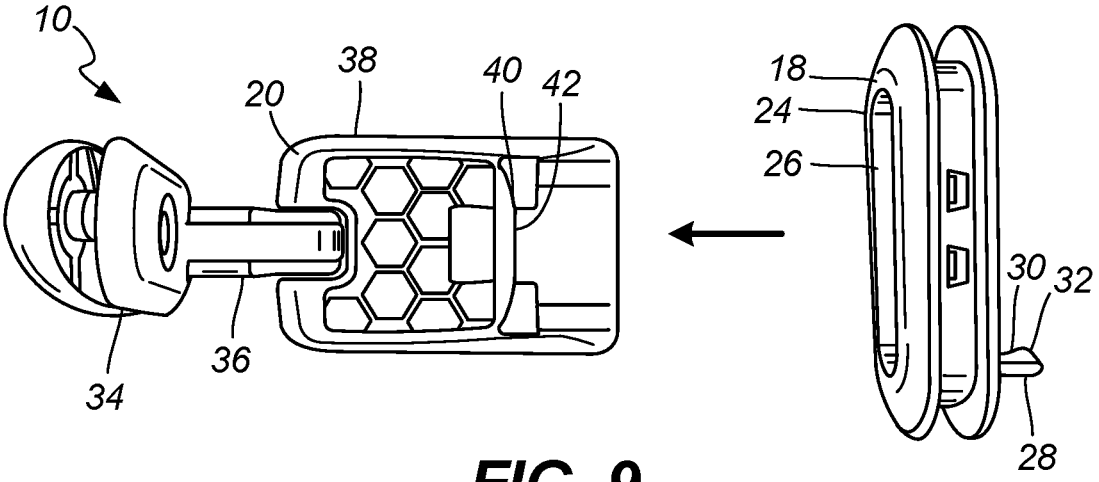
FIGS. 9-12 are views of the first clasp element of the clasp system of FIG. 1 being moved relative to the second clasp element and thereby reconfigured from the unclasped configuration to the clasped configuration.

As shown in FIG. 9 and beginning from the unclasped configuration, the second clasp element 20 is positioned on the opposite side of the first clasp element 18 than the first clasp feature 28, and the second clasp element 20 is oriented relative to the first clasp element 18 so that the plane of the handle 38 is substantially parallel to the longitudinal axis of the aperture 26. The first clasp element 18 is then moved in the direction represented by the arrow in FIG. 9 such that the handle 38 passes through the aperture 26. Stated another way, the base 34 is disposed on a first side of the rim 24, the shaft 36 extends through the aperture 26, and the handle 38 is disposed on a second side of the rim 24.

Figure 10:
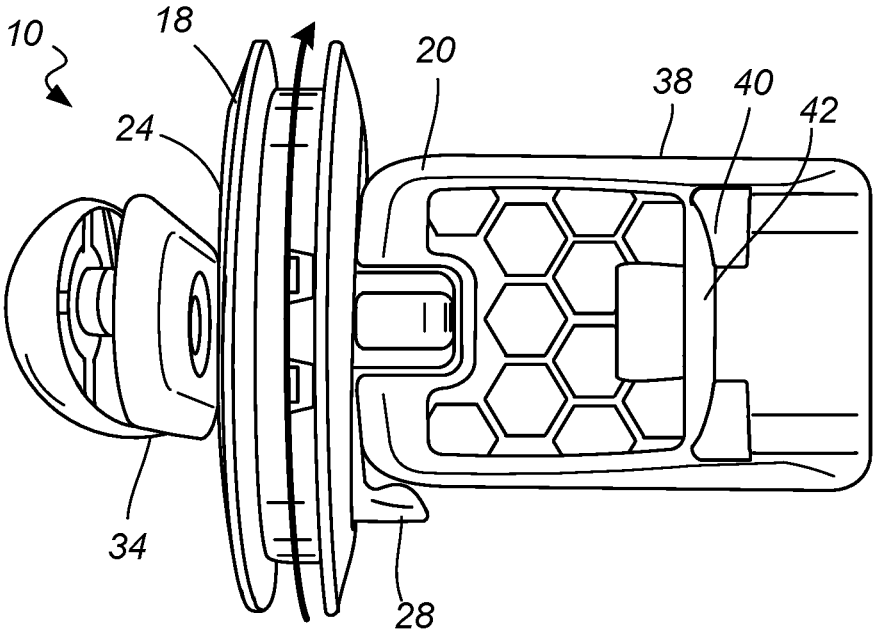
Figure 11:
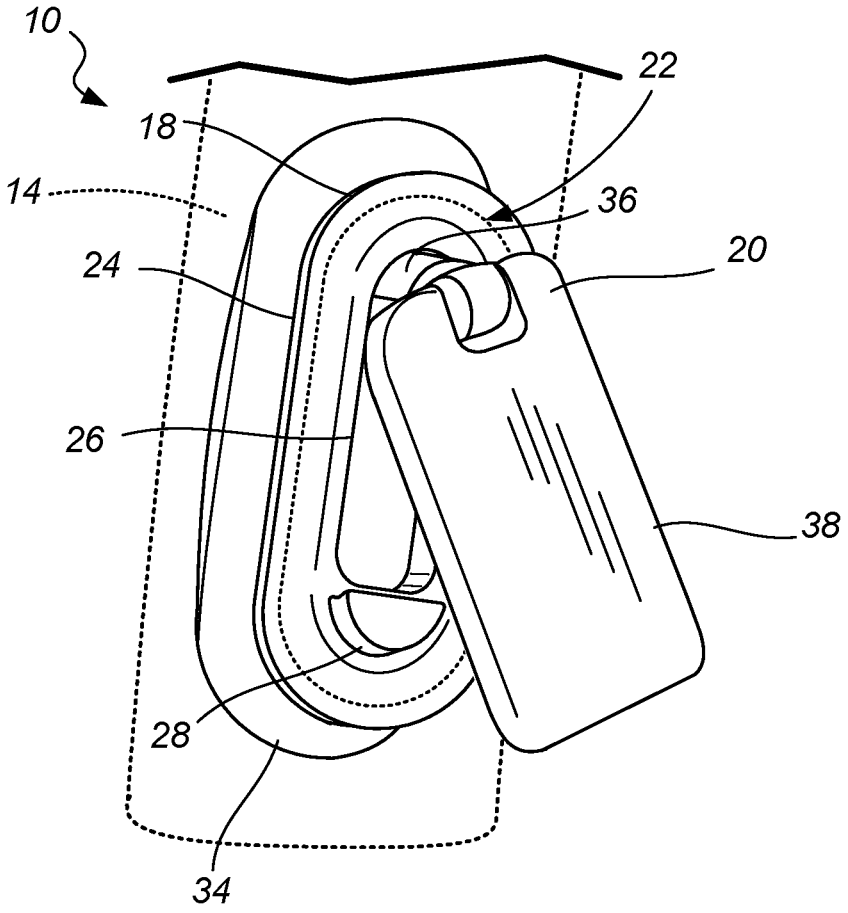

Next and as shown in FIG. 10, the first clasp element 18 is rotated in the direction represented by the arrow in FIG. 10 (that is, about the shaft axis) relative to the first clasp element 18 until the plane of the handle 38 is substantially perpendicular to the longitudinal axis of the aperture 26, as shown in FIG. 11. That is, the first clasp element 18 is rotated substantially 90 degrees about the shaft axis relative to the second clasp element 20.

Figure 12:
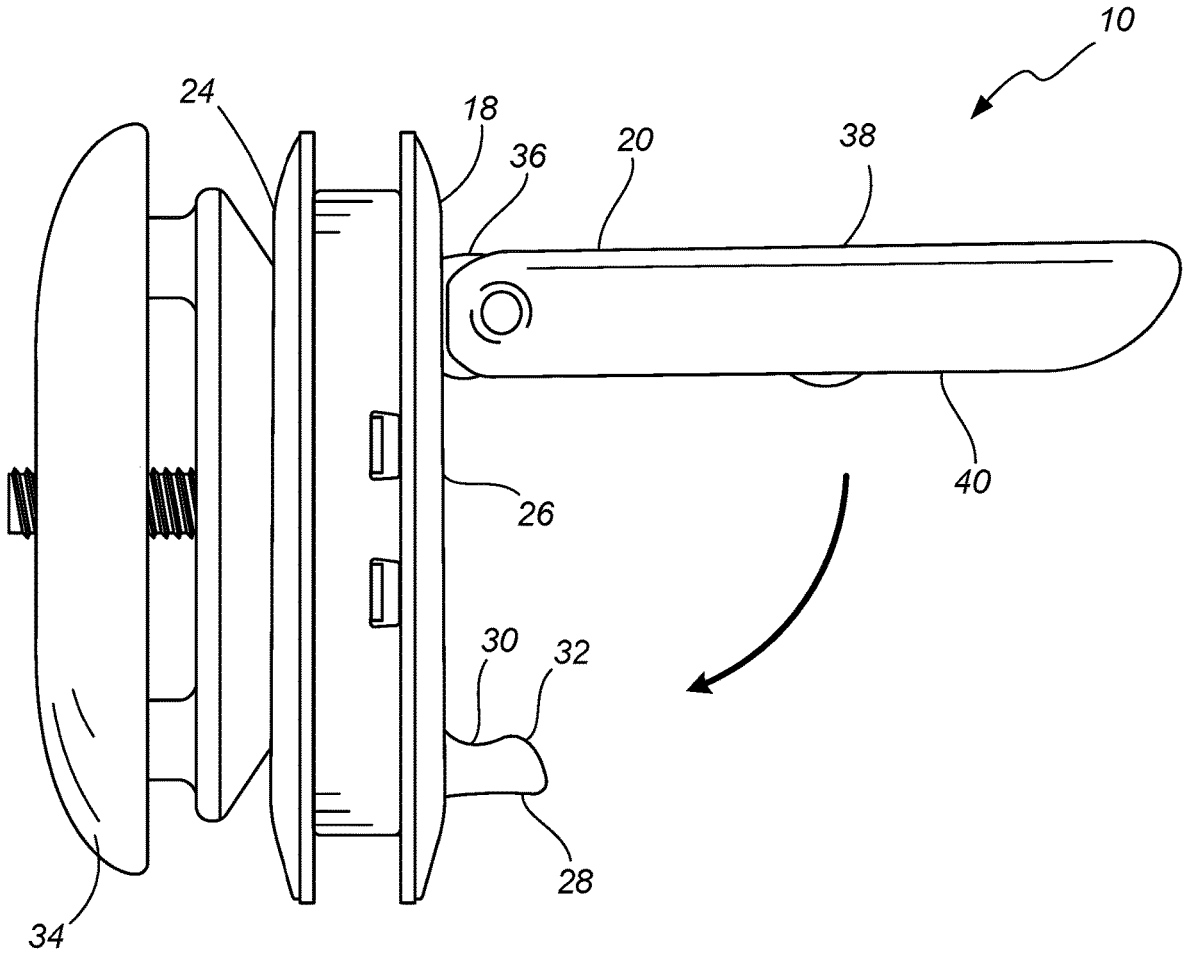
Figure 13:
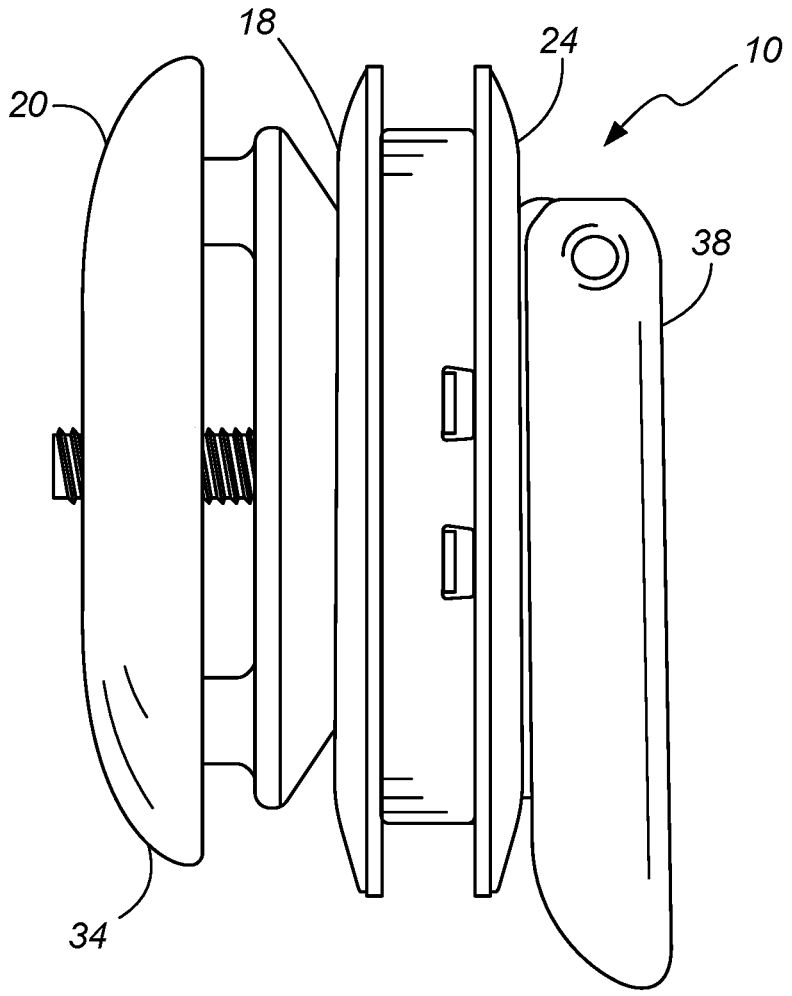

Next and as shown in FIG. 12, the handle 38 of the second clasp element 20 is rotated in the direction represented by the arrow in FIG. 12 relative to the shaft 36 (that is, about the pivot axis by substantially 90 degrees) until the second clasp feature 40 engages and is secured to the first clasp feature 28, as shown in FIG. 13. More specifically, the second clasp feature 40 engages the first clasp feature 28 when the relatively wide portion 32 of the first clasp feature 28 slides over the ridge 42 of the second clasp feature 40 and then the relatively wide portion 32 of the first clasp feature 28 is received in the pocket 46 of the second clasp feature 40. The clasp system 10 is thereby reconfigured in the clasped configuration.

Figure 14:
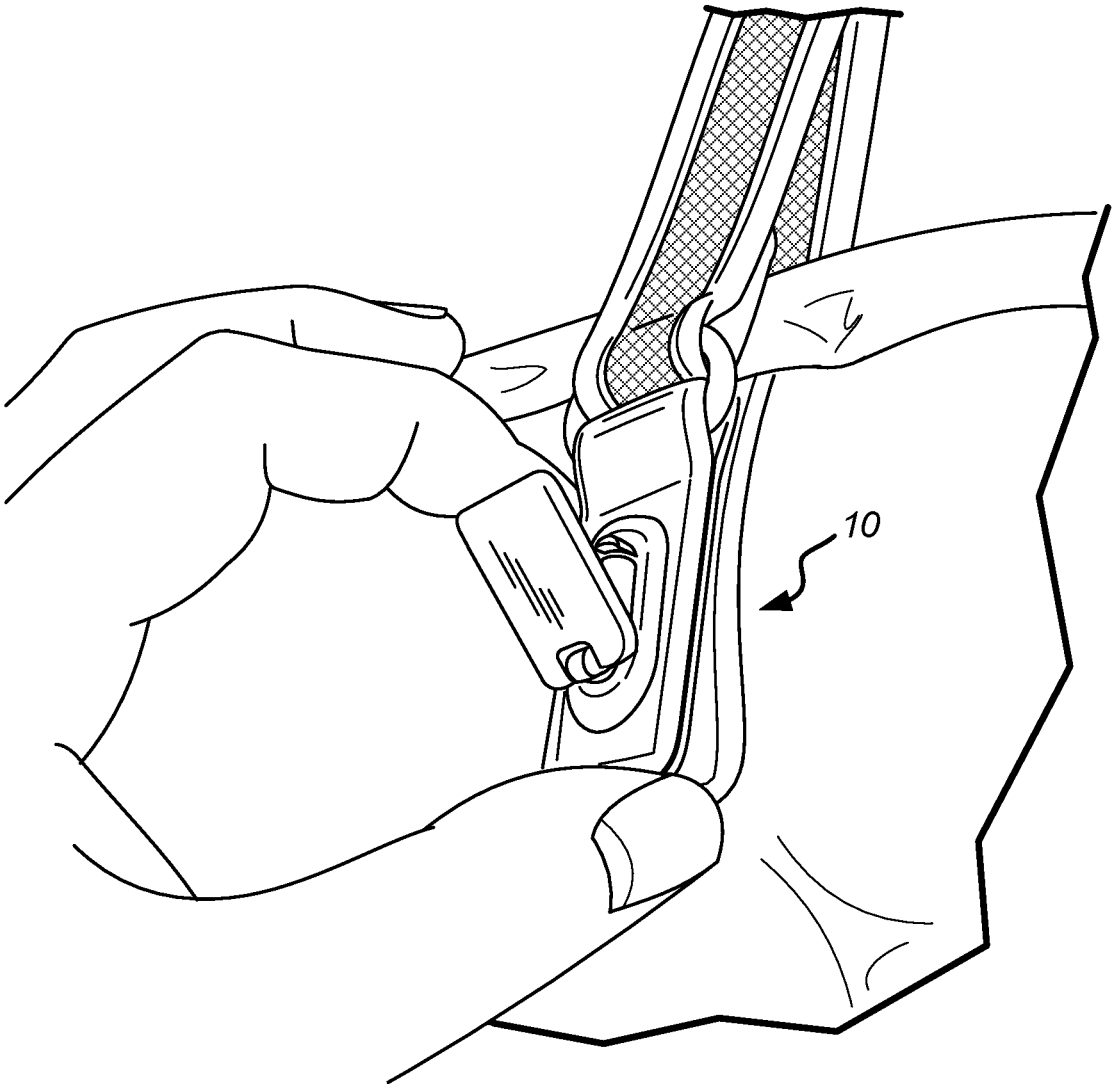
FIGS. 14-16 are views of the clasp system of FIG. 1 being reconfigured from the clasped configuration to the unclasped configuration.
Figure 15:
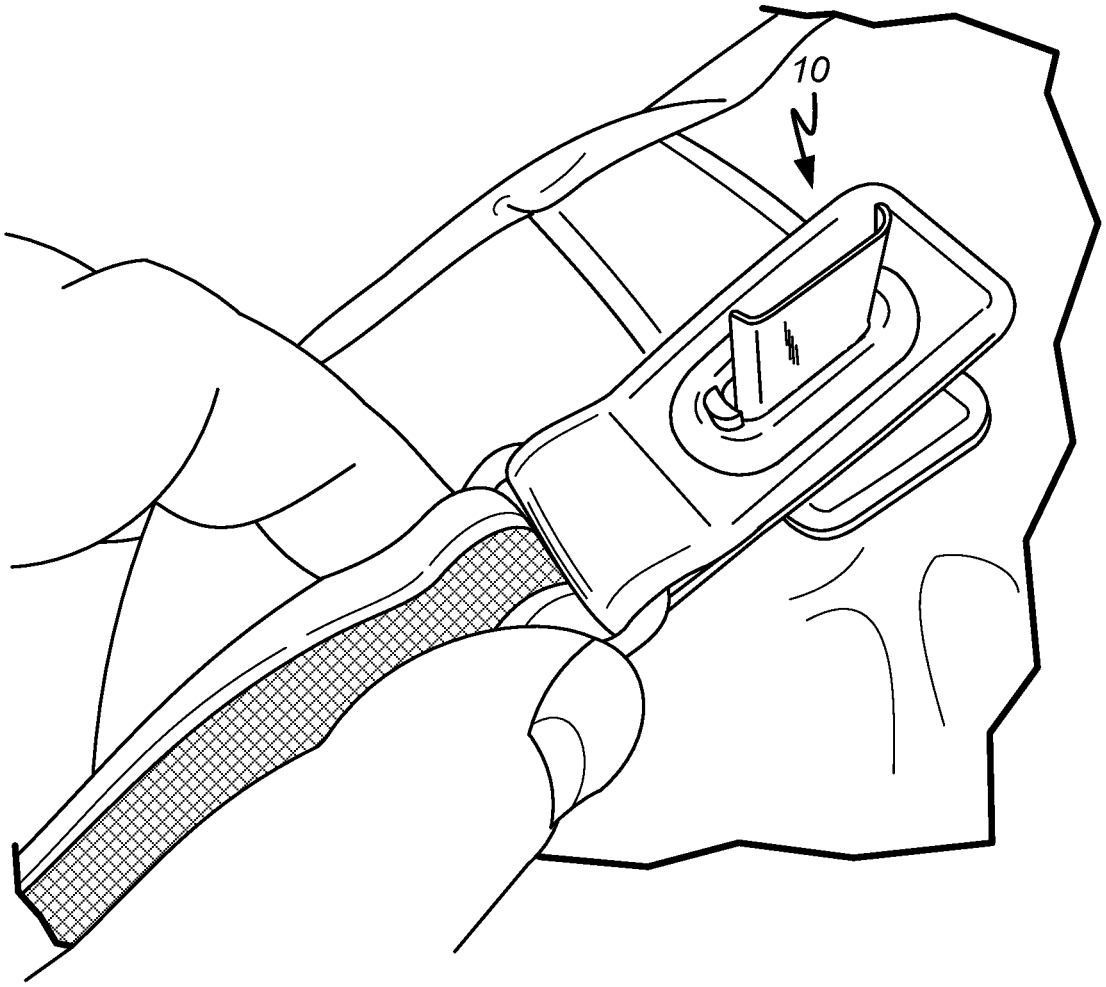
Figure 16:
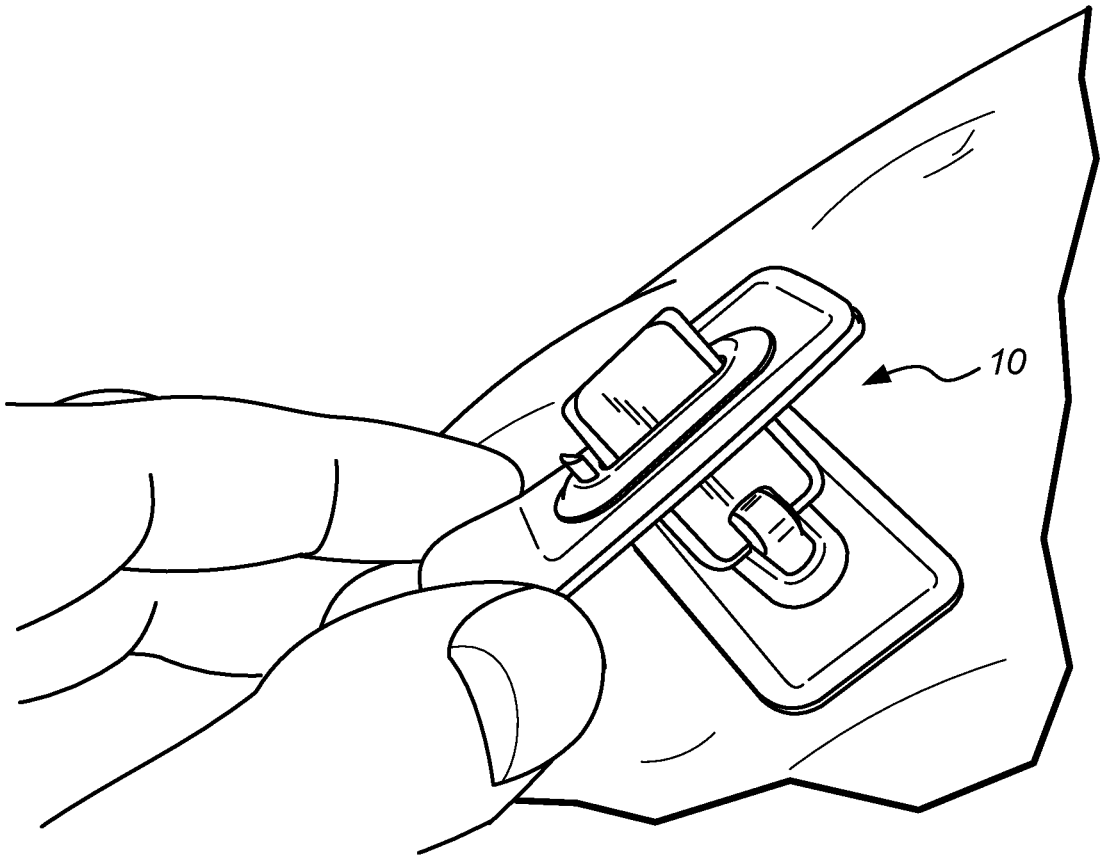

FIGS. 14-16 are views of the clasp system 10 of FIG. 1 being reconfigured from the clasped configuration to the unclasped configuration. Steps for reconfiguring the clasp system 10 from the clasped configuration to the unclasped configuration are essentially the opposite of those for reconfiguring the clasp system 10 from the unclasped configuration to the clasped configuration, as described above.

Aspects of the present invention have been described by way of example only and it should be appreciated that modifications and additions may be made thereto without departing from the scope thereof.

What is claimed is:

1. A clasp system for a baggage item, comprising:

a first clasp element configured to be carried by a first article of the baggage item, the first clasp element comprising:

a rim configured to be coupled to the first article of the baggage item, the rim having a first side and a second side;

an elongated aperture defined within the rim and extending from the first side to the second side of the rim;

a first clasp feature coupled to and extending away from the rim;

a second clasp element configured to be carried by a second article of the baggage item, the second clasp element comprising:

a base configured to be coupled to the second article of the baggage item;

a shaft coupled to the base, the shaft having a shaft axis; and a handle coupled to the shaft opposite the base, the handle being movable through the elongated aperture, the handle being pivotable relative to the shaft about a pivot axis, and the handle comprising a second clasp feature;

wherein the first clasp element and the second clasp element are reconfigurable from an unclasped configuration to a clasped configuration and vice versa, in the unclasped configuration the first clasp element and the second clasp element being disposed apart from each other, and in the clasped configuration the base being disposed on the first side of the rim, the shaft extending through the elongated aperture, the handle being disposed on the second side of the rim, and the second clasp feature engaging the first clasp feature to secure the first clasp element and the second clasp element.

2. The clasp system of claim 1, wherein the elongated aperture has a longitudinal axis, wherein the first clasp feature comprises:

a first portion coupled to the rim;

a second portion coupled to the first portion opposite the rim, the second portion being wider than the first portion in a direction substantially parallel to the longitudinal axis;

wherein the second clasp feature comprises:

a ridge;

a recessed surface coupled to the ridge; and a pocket defined by the ridge and the recessed surface, the pocket receiving the second portion of the first clasp feature in the clasped configuration.

3. The clasp system of claim 2, wherein the second portion of the first clasp feature slides over the ridge of the second clasp feature when the reconfiguring the first clasp element and the second clasp element to the clasped configuration.

4. The clasp system of claim 1, wherein the rim has an oval shape.

5. The clasp system of claim 1, wherein the pivot axis is substantially perpendicular to the shaft axis.

* * * * *